United States Patent [19]

Pipitone et al.

[11] 4,063,049

[45] Dec. 13, 1977

[54] PIEZOELECTRIC ELECTROACOUSTIC TRANSDUCER

[75] Inventors: Roberto Pipitone; Colombo Gnocchi, both of Milan, Italy

[73] Assignee: Societa Italiana Telecomunicazioni Siemens S.p.A., Milan, Italy

[21] Appl. No.: 755,208

[22] Filed: Dec. 29, 1976

[30] Foreign Application Priority Data

Dec. 30, 1975 Italy ..... 30842/75

[51] Int. Cl.[2] ..... H04R 17/00

[52] U.S. Cl. ..... 179/110 A

[58] Field of Search ..... 179/110 A, 181 R; 181/171, 172

*Primary Examiner*—George G. Stellar

*Attorney, Agent, or Firm*—Karl F. Ross

[57] ABSTRACT

An electroacoustic transducer, such as a microphone or a telephone receiver, comprises a thermoplastic body with a central plateau surrounded by an annular recess from which an elastic ring projects slightly above the plateau to support a membrane in the form of sheet-metal foil carrying a piezoceramic layer. The body is overlain by a thermoplastic cover which has apertures for the passage of sound waves and is formed with an internal annular rib registering with the elastic ring to clamp the rim of the membrane therebetween. The body, the cover and a thermoplastic base are joined together by ultrasonic welding.

10 Claims, 1 Drawing Figure

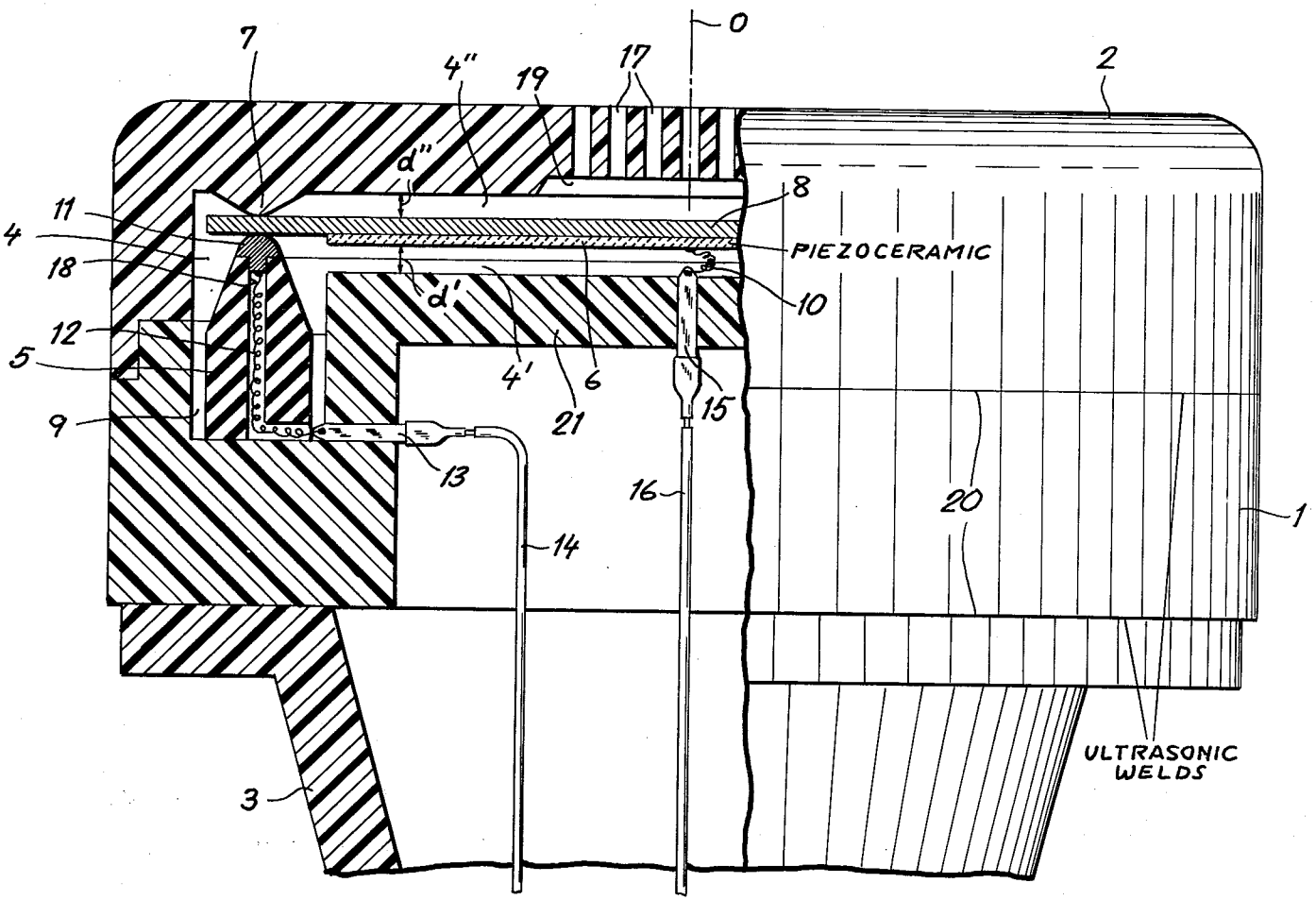
ULTRASONIC WELDS
PIEZOCERAMIC
1
2
3
4
4'
4''
5
6
7
8
9
10
11
12
13
14
15
16
17
18
19
20
21
0
d'
d''

PIEZOELECTRIC ELECTROACOUSTIC TRANSDUCER

FIELD OF THE INVENTION

Our present invention relates to an electroacoustic transducer for the conversion of sound waves into electric signals or vice versa, such as a microphone or a telephone receiver.

BACKGROUND OF THE INVENTION

Recent improvements in this field have led to the development of transducers with piezoelectric membranes which deflect under an applied voltage or generate a potential difference upon being mechanically deformed. The membrane may be supported in the transducer housing by a yieldable mounting designed to keep it as free as possible from extraneous stresses, as with the aid of a resilient clamping ring. The housing itself, which must accommodate not only the membrane but also the associated electrodes, conductors and terminals, is usually split into a main body and a protective cover having apertures for the passage of the sound waves. The airspace surrounding the membrane within the housing, forming what may be described as a sound chamber, must conform closely to its design dimensions for optimum performance; this limits the tolerances within which the distances between confronting internal surfaces of the membrane-supporting body and the cover may vary.

Conventional constructions, in which the supporting body is encapsulated between two metallic shells constituting a cover and a base, create problems of access to the internal conductors after assembly if the two shells are permanently joined by welding. If they are separably interconnected by an edge bead, the maintenance of dimensional stability is difficult.

OBJECTS OF THE INVENTION

The general object of our present invention is to provide a highly compact structure for an electroacoustic transducer of the piezoelectric type which obviates the aforestated drawbacks.

A more particular object is to provide a resilient diaphragm mounting in such a transducer allowing the separation of the diaphragm from a confronting surface on its supporting body to be reduced to a minimum for maximum operating efficiency.

SUMMARY OF THE INVENTION

In accordance with our present invention, a body of dielectric — preferably thermoplastic — material centered on an axis is provided with a central plateau surrounded by an annular recess which receives an elastic ring rising slightly above that plateau to hold a piezoelectric membrane in position, the rim of the membrane being clamped between that ring and an annular rib of an apertured cover of similar dielectric material which overlies the body and forms with it a flat sound chamber around the membrane. Conductors connecting the membrane in an electric circuit are disposed in that body which is provided with tongues, binding posts or other suitable terminals for extending the circuit to either a signal source or a load.

Advantageously, the body is sandwiched between its cover and a hollow base giving access to the terminals. The base, the body and the cover, particularly if made of thermoplastic material, can be permanently interconnected in various ways, e.g., by thermal fusion. We prefer, however, to use ultrasonic welding for this purpose since the entire housing can then be assembled in a single pass through an ultrasonic press, thus expediting mass production of the device.

BRIEF DESCRIPTION OF THE DRAWING

The above and other features of our invention will now be described in detail with reference to the accompanying drawing the sole FIGURE of which is a side-elevational view, partly in section, of an eletroacoustic transducer representing a preferred embodiment.

SPECIFIC DESCRIPTION

The transducer shown in the drawing has a housing of thermoplastic material, centered on an axis 0, comprising a main body 1, a protective cover 2 and a hollow base 3 joined to one another along seams 20 by ultrasonic welding. Cover 2, which has apertures 17 for the emission or reception of sound waves, defines with body 1 an airspace 4 whose lower boundary is formed for the most part by a central plateau 21 of the body, this plateau being surrounded by an annular recess 9. An elastic mounting ring 5 of rubber or the like, whose cross-section converges upwardly toward a narrow ridge, is lodged in recess 9 and serves as support for a membrane consisting of a piezoceramic layer 6 on an overlying metal foil 8. The rim of the foil 8 is clamped, at a level slightly above plateau 21, between the ridge of ring 5 and an internal annular rib 7 of cover 2 confronting that ridge. The depth of recess 9 is several times greater than the height by which the ridge of ring 5 projects above plateau 21, this depth being sufficient to allow elastic deformation of the ring for the absorption of extraneous shocks and vibrations with avoidance of any detrimental stressing of membrane 6, 8.

The airspace 4 is subdivided by the membrane into a lower and an upper compartment 4', 4'' of approximately the same height *d'*, *d''*. In the vicinity of axis 0,the height of compartment 4'' is slightly increased by a depression 19 on the inner surface of cover 2.

Membrane 6, 8 is connected in an electric circuit with the aid of a conductive element 11 at the ridge of ring 5; element 11 could be a short contact or a metal ring encircling the axis 0 along the ridge of rubber ring 5. A flexible lead 12 is shown to extend from conductor element 11 by way of a bore 18 in ring 5 to a clip 13 embedded in body 1 and joined to a wire 14 which passes outwardly through base 3. Another flexible lead 10 extends from the piezoceramic layer 6 to a clip 15, likewise embedded in body 1, which is tied to a second wire 16 also passing outwardly through base 3. These electrical connections have been shown merely by way of example and could be readily modified in accordance with conventional technique.

The piezoceramic layer 6, whose radius is less than those of ring 5 and rib 7 in order to leave a free contact surface on the rim of the disk-shaped foil 8, may consist of barium titanate, for example.

We claim:

1. An electroacoustic transducer comprising a dielectric body centered on an axis and provided with a central plateau surrounded by an annular recess, an apertured dielectric cover overlying said body and forming a flat sound chamber therebetween, an elastic ring in said recess rising above said plateau, said cover being formed within said sound chamber with an annular rib registering with said ring, a piezoelectric membrane in said sound chamber having a rim clamped between said ring and said rib, and conductor means in said body for connecting said membrane in an electric circuit.

2. A transducer as defined in claim 1 wherein said membrane comprises a metallic foil connected to said conductor means and a piezoceramic layer carried on the side of said foil confronting said plateau.

3. A transducer as defined in claim 2 wherein said layer has a radius less than those of said rib and said ring.

4. A transducer as defined in claim 1, further comprising a hollow dielectric base supporting said body.

5. A transducer as defined in claim 4 wherein said body, said cover and said base consist of thermoplastic material.

6. A transducer as defined in claim 5 wherein said body, said cover and said base are joined together by ultrasonic welds.

7. A transducer as defined in claim 1 wherein said ring projects above said plateau by a distance representing a small fraction of the depth of said recess.

8. A transducer as defined in claim 7 wherein said membrane divides said sound chamber into two compartments of approximately equal axial height.

9. A transducer as defined in claim 8 wherein said cover has a central depression slightly increasing the height of the compartment remote from said plateau in the region of said axis.

10. A transducer as defined in claim 1 wherein said ring has a cross-section converging to a narrow ridge in contact with said rim.

* * * * *